United States Patent [19]

Rosen

[11] Patent Number: 4,785,310

[45] Date of Patent: Nov. 15, 1988

[54] FREQUENCY SELECTIVE SCREEN HAVING SHARP TRANSITION

[75] Inventor: Harold A. Rosen, Santa Monica, Calif.

[73] Assignee: Hughes Aircraft Company, Los Angeles, Calif.

[21] Appl. No.: 896,534

[22] Filed: Aug. 14, 1986

[51] Int. Cl.[4] ..... H01Q 15/00; H01Q 19/00

[52] U.S. Cl. ..... 343/909; 343/779

[58] Field of Search ..... 343/909, 779, 753–756, 343/781 P, 908

[56] References Cited

U.S. PATENT DOCUMENTS

| | | | |
|---|---|---|---|
| 3,148,370 | 9/1964 | Bowman | 343/909 |
| 4,017,865 | 4/1977 | Woodward | 343/909 |
| 4,645,487 | 4/1987 | Sureau et al. | 343/909 |
| 4,684,954 | 8/1987 | Sureau et al. | 343/909 |

OTHER PUBLICATIONS

Arnaud et al., "Resonant-Grid Quasioptical Diplexer", Electronics Letters, 13 Dec. 1973, vol. 9, No. 25, pp. 589–590.

Chen et al., "Wideband Sharp Frequency Cutoff Dichroic . . . Applications ", APS Int'l Symposium Digest, Atnennaas and Prop., Albuquerque, N.M., 24–28 May 1982, pp. 463–466.

*Primary Examiner*—William L. Sikes
*Assistant Examiner*—Michael C. Wimer
*Attorney, Agent, or Firm*—Mark J. Meltzer; A. W. Karambelas

[57] ABSTRACT

A frequency selective screen (18) is employed as a diplexer to separate each of one or more radio frequency signals into first and second bands of frequencies by allowing the first band of frequencies to pass therethrough and reflecting the second band of frequencies. The screen (18) includes an array of discrete, electrically conductive elements (32), preferably copper, formed on a substrate (33) such as a layer of polyimide. The conductive elements (32) possess a geometry which results in an equivalent electrical circuit (50) that exhibits parallel resonance, high impedance within the first band of frequencies and series resonance, low impedance within the second band of frequencies, thereby transmitting the signal in the first frequency band and reflecting the signal in the second frequency band. The screen (18) may include first and second portions (18*a*, 18*b*) in which the conductive elements (32) are respectively oriented along different axes to respectively separate horizonally and vertically polarized signals. The screen (18) may be employed in a satellite (10) to separate transmit and receive frequencies.

14 Claims, 4 Drawing Sheets

FREQUENCY SELECTIVE SCREEN HAVING SHARP TRANSITION

TECHNICAL FIELD

The present invention broadly relates to diplexers for separating radio frequency signals into their component frequency parts, and deals more particularly with a frequency selective screen adapted to separate a radio signal into first and second frequency bands.

BACKGROUND ART

It is often desirable in radio antenna transmitting or receiving systems to separate a radio frequency signal into separate frequency bands. In some applications, a so-called quasi-optical diplexer has been employed in the past to separate coincident radio signals of different frequency bands. For example, one such use of a quasi-optical diplexer is disclosed in "Imaging Reflector Arrangements to Form a Scanning Beam Using a Small Array," C. Dragone and M. J. Gans, *The Bell System Technical Journal,* Volume 58, No. 2, February, 1979. In this publication, a frequency diplexer is positioned between a transmit array and an imaging reflector. A receive array is positioned on one side of the diplexer, opposite that of the transmit array. Signals in the transmit band pass from the transmit array through the diplexer to the imaging reflector. The diplexer is reflective of signals in the recieve band, consequently, a signal in the receive band which is incident on the diplexer is reflected onto the receive array. The arrangement discussed immediately above is particularly compact and therefore finds useful application in satellite antenna systems.

Resonant-grid, quasi-optical diplexers of various configurations are disclosed in "Resonant-Grid Quasi-Optical Diplexers," J. A. Arnaud and F. A. Pelow, *The Bell System Technical Journal,* Volume 54, No. 2, February, 1975, and "On the Theory of Self-Resonant Grids," I. Anderson, *The Bell System Technical Journal,* Volume 54, No. 10, December, 1975. As discussed in these two latter-mentioned articles, in many millimeter-wave systems associated with communication satellite antennas or Hertzian cables, quasi-optical filters and diplexers are quite useful. Because of their large areas, quasi-optical devices have large power-handling capability and the problem of multi-moding is, in a sense, avoided. The ohmic losses can be small, and the grids are easy to manufacture by photolithographic techniques. These articles disclose a number of single-grid and double-grid diplexers. Each of the grids includes grid elements of various configurations which effectively form either a capacitance or an inductance. A grid, regardless of its geometry or design, can be represented by circuit elements that are found empirically by fitting the measured response curve of the grid to one calculated from the equivalent circuit. The article "Resonant-Grid Quasi-Optical Diplexers" mentioned above discloses numerous grid patterns, including a grid arrangement having capacitive elements that resemble a so-called "Jerusalem cross". At the resonant frequency, the Jerusalem cross grid is perfectly reflecting and behaves as a plain sheet of copper.

The frequency transition for prior art, quasi-optical diplexers has not been particularly sharp and the difference in the reflectivity of the separate frequency bands has not been sufficiently great for some applications. Moreover, the width of the separate frequency bands has been less than desired for some applications. Finally, because of the relatively narrow separation of frequency bands in some systems, it has been necessary to employ multiple frequency select screens which must be carefully oriented relative to each other, whereas the use of a single screen would have been preferred.

The present invention overcomes the deficiencies of the prior art discussed above.

SUMMARY OF THE INVENTION

According to the present invention, a frequency selective screen, or diplexer is provided for separating first and second relatively close frequency bands of radio frequency signal, especially in the microwave range, which comprises an array of electrical conductive elements arranged to provide an equivalent circuit exhibiting parallel circuit resonance within the first frequency band and series circuit resonance within the second frequency band. The conductive elements are arranged in a planar, N x M array, and such that the equivalent circuit includes a first portion having a first inductance and a first capacitance in parallel with each other, and a second portion coupled in series with the first portion which includes a second capacitance.

Each conductive element includes a pair of spaced-apart side legs, each forming an inductance, a pair of spaced-apart connecting legs which extend between and connect the side legs. The connecting legs of adjacent elements are closely spaced to form a series capacitance in the equivalent circuit. Each element further includes a pair of medical legs extending from the connecting legs toward each other and define a second inductance. An additional pair of central legs connected to the ends of the medial legs are closely spaced from each other to form a second capacitance which is in parallel with the first inductance in the equivalent circuit.

The frequency selective screen is preferably manufactured by forming the electrically conductive elements on a polyimide film using conventional photolithography techniques. In one embodiment of the screen, the conductive elements are segregated into two halves, with the elements in one half being rotated 90° relative to the other half, such that the two halves of the diplexer can operate on signals having horizontal and vertical polarization respectively.

Accordingly, it is a primary object of the present invention to provide a frequency selective screen useful as a diplexer having extremely sharp transition characteristics for separating a radio signal into first and second frequency bands, especially where the bands are relatively close in frequency to each other.

A further object of the present invention is to provide a diplexer as described above which exhibits parallel resonance and thus high impedance within one band of frequencies, and series resonance and thus low impedance within another band of frequencies.

A still further object of the present invention is to provide a diplexer as mentioned above which is suitable for use in separating each of two signals into first and second frequencies bands, wherein the two signals are respectively of differing polarizations.

These, and further objects and advantages of the present invention will be made clear or will become apparent during the course of the following description of the invention.

DESCRIPTION OF THE PREFERRED EMBODIMENT

Referring first to FIGS. 1–4, the present invention broadly relates to a frequency selective screen 18 which may be used for example in the antenna system of a communications satellite 10. The satellite 10 may comprise a typical spin-stabilized satellite placed in geosynchronous orbit above the earth's surface. The antenna system is typically mounted on a despun platform so that the antenna system maintains a constant orientation with respect to the earth. It is to be understood however, that the satellite antenna system disclosed herein is merely illustrative of one of the many applications of the frequency selective screen 18 of the present invention.

The antenna system of the satellite 10 includes two primary antenna subsystems in addition to a conventional omni antenna 13. The first subsystem is of a point-to-point type in which the system acts as a two-way communication link to interconnect earth stations for two-way communication. The second subsystem, commonly referred to as CONUS (Continental United States) essentially acts as a transponder to broadcast, over a wide pattern covering the entire United States or other geographic area, signals received from one or more particular locations on earth. The point-to-point transmit signal and the CONUS receive signal are vertically polarized. The CONUS transmit and point-to-point receive signals are horizontally polarized. The antenna system includes a large reflector assembly 12 comprising two reflectros **12*a*, 12*b* which are slightly rotated relative to each other about a common axis so as to provide slightly different orientations with respect to the remaining components of the antenna system to be described below. The reflectors 12*a*, 12*b* are thus disposed orthogonally relative to each other and intersect at their midpoints so that disturbances of the incident waves is minimized. The reflector 12*a*is horizontally polarized and operates with horizontally polarized signals and the reflector 12*b* is vertically polarized and therefore operates with vertically polarized signals. Consequently, each of the reflectors 12*a*, 12*b* reflects signals which the other reflector 12*a*, 12*b*** transmits.

Figure 1:
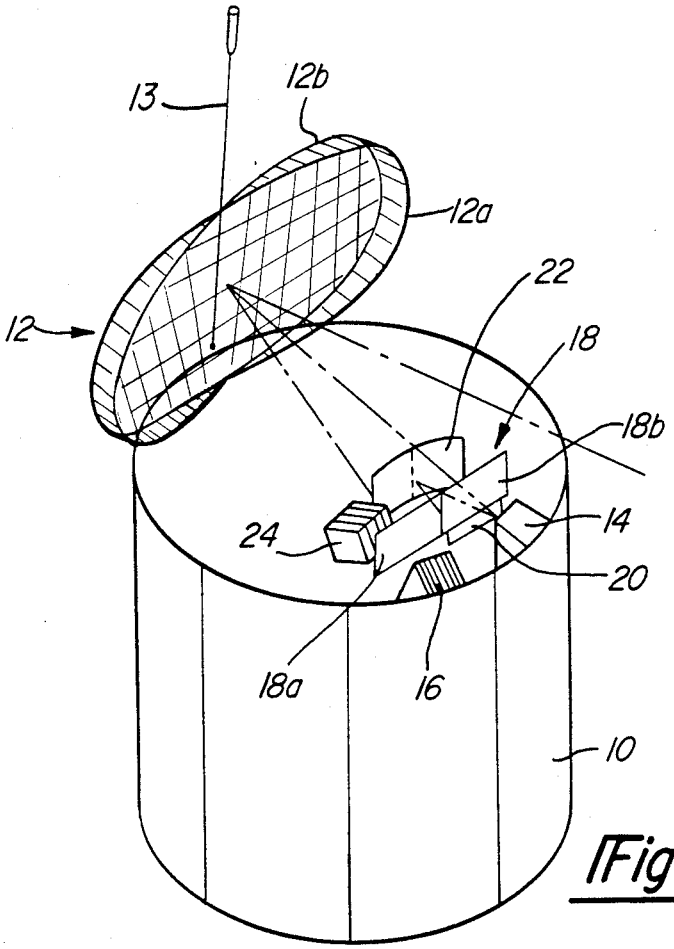
FIG. 1 is a perspective view of the antenna system of a communications satellite which employs the frequency selective screen of the present invention.
Figure 3:
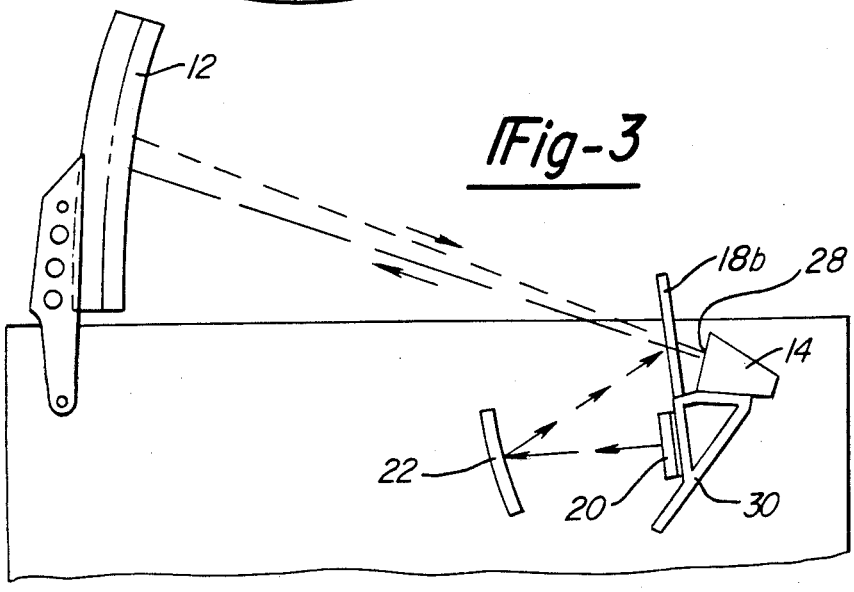
FIG. 3 is a sectional view taken along the line 3—3 in FIG. 2.
Figure 2:
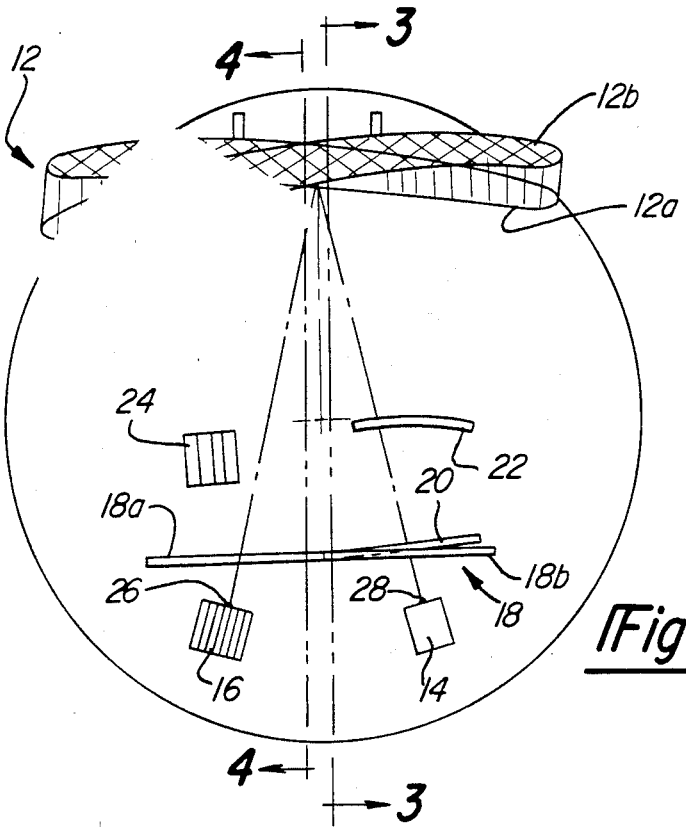
FIG. 2 is a top plan view of the antenna system shown in FIG. 1.
Figure 4:
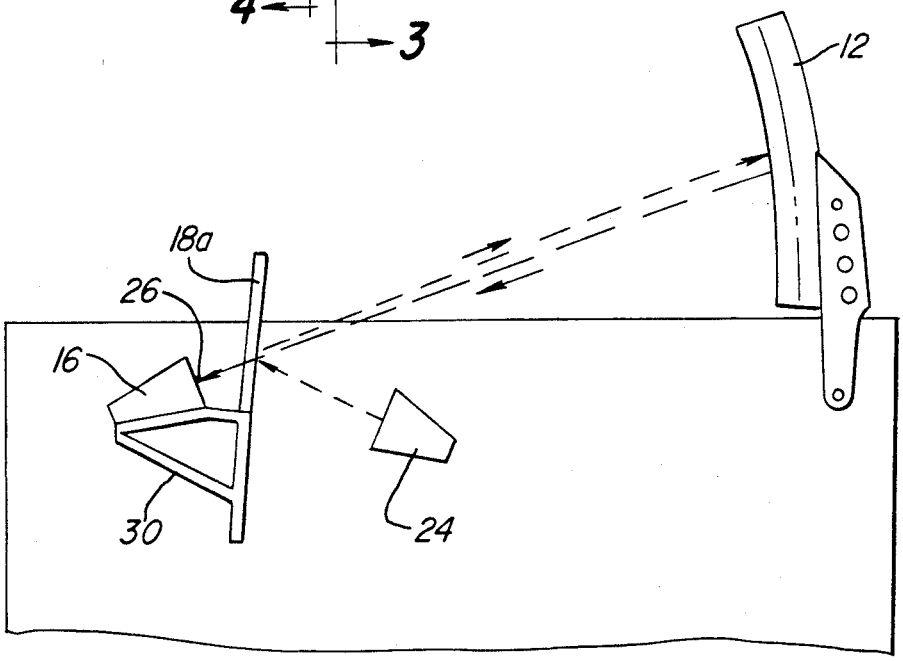
FIG. 4 is a sectional view taken along the line 4—4 in FIG. 2.

The frequency selective screen 18 includes two halves **18*a*, 18*b* and is mounted on a support 30 such that the screen halves 18*a*, 18*b* are disposed on opposite sides of a center line passing diametrically through the satellite 10, as best seen in FIG. 2. The details of the frequency selective screen 18** will be discussed later herein.

The CONUS subsystem includes a receiver 14 mounted on the support 30 behind one half **18*b* of the screen 18 such that vertically polarized signals received and reflected by reflector 12*b* pass through the frequency selective screen half 18*b* to the receiver 14 and are focused at a focal point 28 of the reflector 12*b*. The CONUS transmitter 24 may typically comprise a pair of horns or the like and is mounted slightly below and forward of the screen portion 18*a*. The transmitter 24 is oriented such that the horizontally polarized signal emanating therefrom is incident on the forward side of the screen half 18*a* which functions to reflect this signal to the horizontally polarized reflector 12*a***, which in turn reflects the signal to the earth.

The point-to-point subsystem broadly includes a transmit array 20, a subreflector 22 and a receiver 16. The transmit array 20 is mounted on the support 30, immediately beneath the screen 18. The subreflector 22 is mounted forward of the transmit array 20 and slightly below the screen 18. The signal emanating from the transmit array 20 is reflected by the subreflector 22 onto one half **18*b* of the screen 18. The subreflector 22 functions to effectively magnify the pattern of the signal emanating from the transmit array 20. The magnified signal reflected from the subreflector 22 is in turn reflected by one half 18*b* of the screen 18 onto the large reflector 12*b*, which in turn reflects the transmitted point-to-point signal to the earth. The receiver 16 is positioned at the focal point 26 of the reflector 12*a***.

From the foregoing, it can be appreciated that the frequency selective screen 18 effectively separates the transmitted and received signals for both the CONUS and point-to-point subsystems. It may be further appreciated that the two halves **18*a*, 18*b* of the screen 18** are respectively adapted to separate individual signals which are horizontally and vertically polarized.

Figure 5:
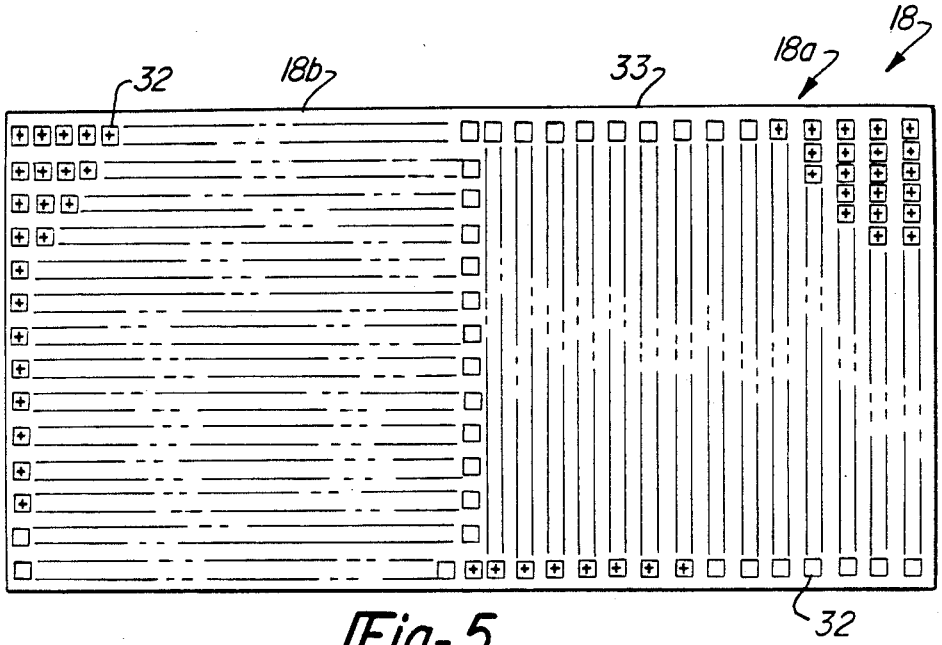
FIG. 5 is a front elevational view of the frequency selective screen employed in the antenna system shown in FIG. 1.
Figure 7:
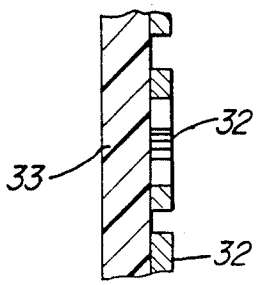
FIG. 7 is a sectional view taken along line 7—7 in FIG. 6.

As shown in FIG. 5 and FIG. 7, each half **18*a*, 18*b* of the frequency selective screen 18 comprises an $N \times M$ array of discrete, electrically conductive elements 32. The conductive elements 32 may be formed of any suitable conductive material, such as copper, and are disposed on a suitable substrate 33 through which a radio frequency signal may pass. In the preferred form of the invention, the screen 18 is fabricated by first applying a layer of conductive material on a polyimide such as Kapton and then etching away the undesired portions of the copper layer, using conventional photoetching techniques to refine the individual, discrete elements 32. The two halves 18*a*, 18*b* may be defined on a common substrate 33 as shown in FIG. 5 so as to lie in a common plane, or may be defined on separate substrates so that the two halves 18*a*, 18*b*** may be oriented in different planes.

The spacing between adjacent columns of elements 32 in screen half **18*a* is considerably greater than the spacing between adjacent rows thereof. Conversely, the spacing between adjacent rows of the elements 32 in screen 18*b* is considerably greater than the spacing between adjacent columns. In effect, the screen halves 18*a*, 18*b* are identical to each other with one being rotated 90° with respect to the other. Accordingly, the screen half 18***a* is adapted to be employed with horizontally polarized signals while the screen half 18*b* is adapted to be employed with vertically polarized signals.

Figure 6:
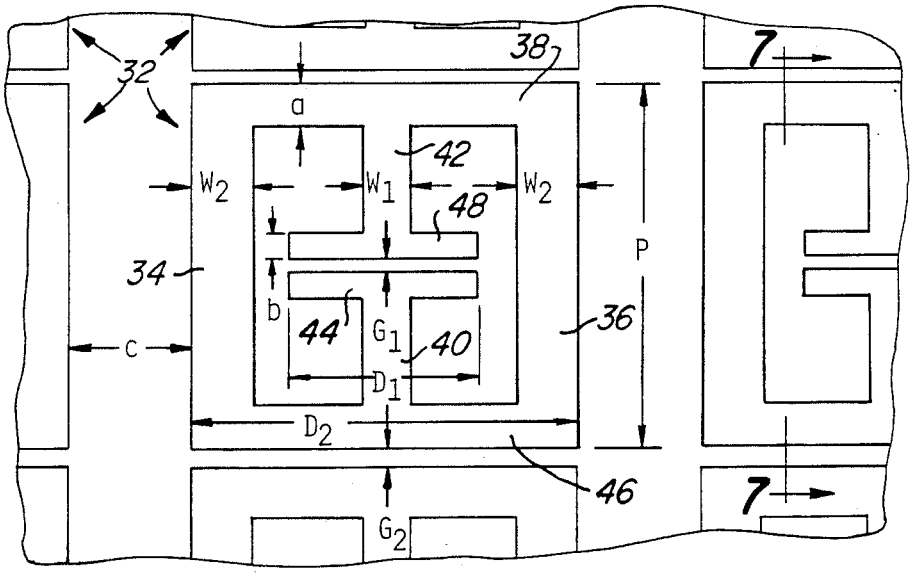
FIG. 6 is a greatly enlarged, fragmentary view of a portion of the screen shown in FIG. 5.

Reference is now made to FIG. 6 and FIG. 7 which is an enlarged view of a portion of the screen half 18*a*, and wherein the construction details and geometry of each of the elements 32 are depicted with greater clarity. Each of the conductive elements 32 comprises an outer, rectangular ring defined by a pair of parallel side legs 34, 36 and a pair of parallel connecting legs 38, 46. Each of the side legs 34, 36 possesses a preselected width $W_2$ and the connecting legs 38, 46 each possess a preselected width "a". Each of the elements 32 further includes a pair of medial legs 40, 42 which extend toward each other and are connected with the corresponding connecting legs 38, 46. The medial legs 40, 42 extend parallel to the side legs 34, 36 and each possess a preselected width $W_1$. Connected with the inner extremities of each of the medial legs 40, 42 are a pair of respectively associated central legs 44, 48. The legs 44, 48 extend parallel to each other and parallel to the connecting legs 38, 46. The central legs 44, 48 each possess a preselected width "b" and are spaced apart a preselected distance $G_1$. The overall width and height of each of the elements 32 are respectively indicated by $D_2$ and P. The connecting legs 38, 46 of each element 32 are spaced apart from the connecting leg 46 of an adjacent element 32 by a preselected distance $G_2$, while the side legs 34, 36 are spaced from the side leg of an adjacent element 32 by a preselected distance C.

Figure 8:
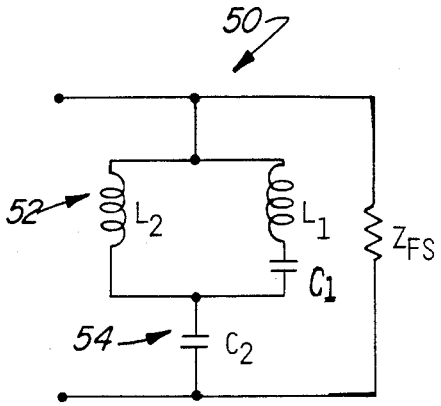
FIG. 8 is a detailed schematic diagram of the equivalent circuit of one of the conductive elements of the screen shown in FIG. 5.

Referring now concurrently to FIGS. 6 and 8, legs 34, 36, 40 and 42 define inductances while central legs 44 and 48 as well as the opposing, closely spaced connecting legs 38, 46 of adjacent elements 32 form capacitances. The unique geometry of the conductive elements 32 provides an equivalent electrical circuit shown in FIG. 8 which exhibits parallel circuit resonance within one frequency band and series circuit resonance within a second frequency band. The equivalent circuit, generally indicated by the numeral 50, includes a parallel circuit 52 connected in series relationship with a series circuit 54. The series and parallel circuits 52, 54 are coupled in parallel relationship with the impedance of free space $Z_{fs}$. The parallel circuit 52 comprises an inductance $L_1$ and a capacitance $C_1$ in parallel with an inductance $L_2$. The series circuit 54 comprises capacitance $C_2$. Inductance $L_1$ is formed by the medial legs 40, 42 and the value thereof is determined by the width $W_1$. Capacitance $C_1$ is formed by the central legs 44, 48 and the value thereof is determined by the spacing $G_1$ between legs 44, 48. Inductance $L_2$ is formed by the side legs 34, 36 and the value thereof is determined by the width $W_2$ of legs 34, 36. Finally, capacitance $C_2$ is provided by the opposing, closely-spaced connecting legs 38, 46 of adjacent elements 32 and the spacing therebetween, $G_2$, determines the value of capacitance $C_2$.

In the receive band of frequencies, the parallel circuit 52 is resonant, consequently the equivalent circuit 50 and thus the screen 18 exhibits parallel resonance and a high impedance. Accordingly, the screen 18 is substantially transparent to the receive band of frequencies. In the transmit band of frequencies, the equivalent circuit 50 exhibits series resonance and thus a low impedance. Accordingly, the screen 18 is substantially conductive and acts as a substantially reflective surface to reflect the incident signals in the transmit band of frequencies.

Figure 9:
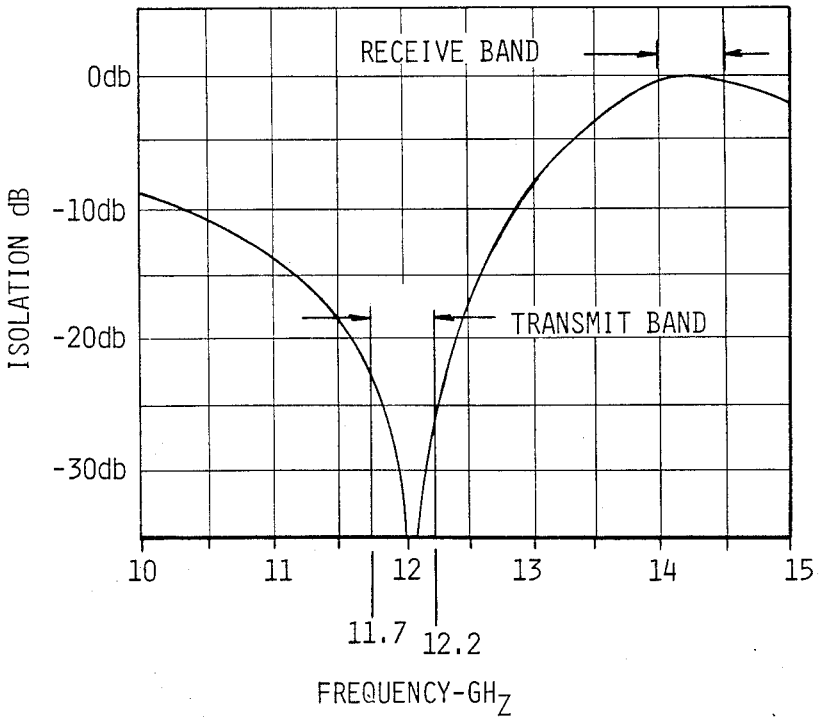
FIG. 9 is a plot of the transmission characteristic of the frequency selective screen of the present invention.

The sharp transition characteristics of the frequency selective screen of the present invention are depicted in FIG. 9 in which transmission of a radio frequency signal through the screen 6 is plotted based on an assumed 45° angle of incidence. In this present example, the transmit band is between 11.7 and 12.2 GHz, while the receive band is between 14 and 14.5 GHz and is therefore relatively close to the transmit band. As shown in the plot of FIG. 9, the receive band of frequencies pass essentially unattenuated through the screen while the frequencies on either side of the receive band drop off sharply in strength and, in fact, the transmit band is reduced in strength over 20 dB; this corresponds to a transmission of approximately one percent and a reflection of 99%.

Typical values for the dimensions of each of the elements 32 discussed above for the transmit and receive frequencies cited above, in inches, are as follows:

$W_1=0.040$
$D_1=0.090$
$G_1=0.010$
$W_2=0.060$
$D_2=0.250$
$G_2=0.010$
$P=0.200$
$a=0.030$
$b=0.015$
$c=0.080$

Having thus described the invention, it is recognized that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A diplixer for separating first and second frequency bands of a radio frequency signal, comprising:

a substantially planar $N \times M$ array of adjacent electrically conductive, discrete elements arranged in N rows and M columns, each of said elements including (1) a pair of spaced apart side legs each having a preselected width and forming a first inductance, (2) a pair of spaced apart connecting legs extending between and connecting said side legs, a connecting leg in each of said pairs thereof opposing and being spaced from a connecting leg of an adjacent element a preselected distance to form a first capacitance between at least certain adjacent ones of said elements, (3) a pair of medial legs respectively extending from said connecting legs toward each other, each of said medial legs having a preselected width and defining a second inductance, and (4) means on one end of said medial legs defining a second capacitance.

2. The diplexer of claim 1, wherein the spacing between the elements in adjacent columns thereof being substantially greater than the preselected spacing between the opposing connecting legs of adjacent elements in a column thereof.

3. The diplexer of claim 1, wherein the spacing between the elements of the adjacent columns thereof is sufficiently great such that there is substantially no capacitance formed by the elements in the adjacent columns thereof.

4. The diplexer of claim 1, wherein the opposite ends of each of said connecting legs are respectively contiguous with one set of ends of said side legs.

5. The diplexer of claim 1, wherein said connecting legs and said side legs collectively form a rectangular ring.

6. The diplexer of claim 1, wherein said medial legs extend substantially normal to the respectively associated connecting legs.

7. The diplexer of claim 1, wherein said means defining a second capacitance includes a pair of parallel opposing legs, said parallel opposing legs being spaced apart a preselected distance.

8. The diplexer of claim 7, wherein said parallel opposing legs extend parallel to each of said connecting legs.

9. The diplexer of claim 1, wherein said diplexer includes a substantially planar substrate through which said signal may pass and said elements are each defined by a layer of electrically conductive material on the surface of said substrate.

10. The diplexer of claim 9 wherein said substrate is polyimide and said conductive material includes copper.

11. The diplexer of claim 1, wherein said first and second inductances, and said first and second capacitances form an equivalent electrical circuit, and wherein said equivalent circuit includes a first branch wherein said second capacitance and said second inductance are in series with each other, a second branch in parallel with said first branch and including said first inductance, and a third branch in series with the combination of said first and second branch, said third branch including said first capacitance.

12. The diplexer of claim 1, wherein said first and second inductances, and said first and second capacitances of each of said elements form an equivalent circuit which is resonant within said first and second band of frequencies.

13. The diplexer of claim 1, wherein said first and second inductances, and said first and second capacitances of each of said elements form an equivalent circuit having a relatively high impendance within said first band of frequencies and a relatively low impedance within said second band of frequencies.

14. The diplexer of claim 13, wherein:

said first frequency band comprises transmit frequencies and said equivalent circuit exhibits series resonance within said first frequency band, and said second frequency band is higher in frequency than said first band of frequencies and comprises receive frequencies, said equivalent circuit exhibiting parallel resonance within said second band of frequencies.

* * * * *